United States Patent [19]

Harris

[11] Patent Number: 4,583,269

[45] Date of Patent: Apr. 22, 1986

[54] TOWEL RAIL CLAMP

[76] Inventor: John Harris, 11337 Terry, Detroit, Mich. 48227

[21] Appl. No.: 643,623

[22] Filed: Aug. 23, 1984

[51] Int. Cl.[4] ..... A44B 21/00; A41F 1/00

[52] U.S. Cl. ..... 24/495; 24/508; 24/509; 24/523; 223/96; 248/154

[58] Field of Search ..... 24/495, 507, 508, 509, 24/523; 248/316.7, 154; 223/90, 96

[56] References Cited

U.S. PATENT DOCUMENTS

| | | | |
|---|---|---|---|
| 695,924 | 3/1902 | Grotenhuis | 223/96 |
| 1,273,741 | 7/1918 | Clews | 24/495 |
| 1,615,889 | 2/1927 | Senn | 24/509 |
| 2,278,735 | 4/1942 | Perry | 24/509 |
| 2,473,408 | 6/1949 | Alkin | 24/509 |
| 2,483,188 | 9/1949 | Elger | 24/523 |
| 2,889,094 | 6/1959 | Vigor | 223/96 |
| 3,999,252 | 12/1976 | Bianco | 248/316.7 |

FOREIGN PATENT DOCUMENTS

| | | | |
|---|---|---|---|
| 1352534 | 1/1964 | France | 248/316.7 |
| 2212 | of 1892 | United Kingdom | 24/507 |
| 1833 | of 1910 | United Kingdom | 223/89 |

*Primary Examiner*—Victor N. Sakran
*Attorney, Agent, or Firm*—Harvey B. Jacobson

[57] ABSTRACT

A clamp for gripping a towel draped over a towel rail so as to prevent the towel from sliding off the rail comprises a pair of arm members with jaw-forming portions at one end and handle portions at the other end, a pivot bar connecting the arm members between the ends, and a spring assembly connected between the arm members adjacent the pivot bar, the spring assembly urging the jaw-forming portions of the arm members toward one another to grip the towel therebetween. Release of the clamp to allow removal of the towel from the rail is effected by squeezing the handle portions toward one another to open the jaws against the spring action.

7 Claims, 3 Drawing Figures

TOWEL RAIL CLAMP

BACKGROUND OF THE INVENTION

This invention relates to a clamp structure more particularly although not exclusively for releasably clamping towels draped over a towel rail in place, so as to prevent the towels from slipping off the rail. Clearly, however, clamps in accordance with the invention are suitable for other analogous uses, for example for clamping clothing on rails, hangers or the like.

STATEMENT OF PRIOR ART

The following U.S. patents pertain to spring clamps, clips and similar devices. None of these, however, discloses a clamp having the features of the present invention. U.S. Pat. Nos.:

663,424
1,615,889
2,278,735
2,473,408
2,483,188

SUMMARY OF THE INVENTION

A towel rail or like clamp in accordance with the invention comprises a pair of opposed arm members with jaw-forming portions at their one end, and handle portions at their other end, a pivot bar connecting the arm members intermediate their ends, and a spring assembly interconnecting the arm members adjacent the pivot bar for urging the jaw-forming portions toward one another.

To operate the clamp, the handle portions are squeezed inwardly against the spring pressure, pivoting the arm members on the pivot bar and opening the jaws, thereby allowing them to be positioned, for example, over a towel on a towel rail and clamped against the towel when the handle portions are released.

The arm members may be stepped outwardly adjacent the jaw-forming portions so that the jaws are wider apart than the handles, and the spring assembly may comprise a coil spring connected between the arm members, with a surrounding stop tube which limits the amount of closing of the jaws (and opening of the handles) thereby facilitating manipulation of the clamp. The jaws may be transversely elongated so that a single clamp may, for example, be used on two adjacent towels on a rail.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 1:
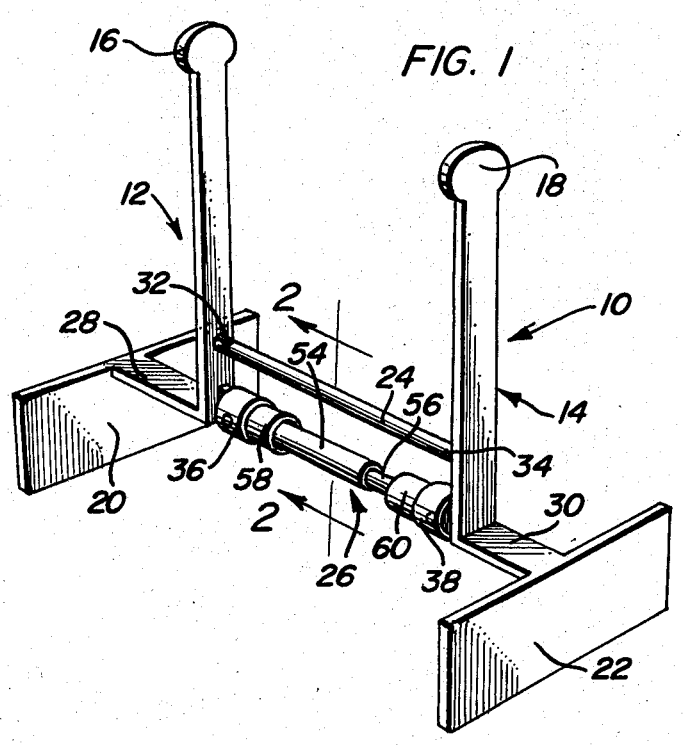
FIG. 1 is a perspective view of a towel rail clamp in accordance with the invention.
Figure 2:
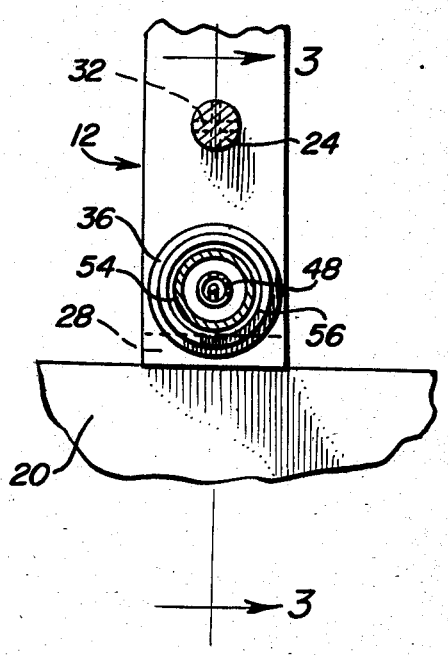
FIG. 2 is an enlarged sectional view on line 2—2 of FIG. 1.
Figure 3:
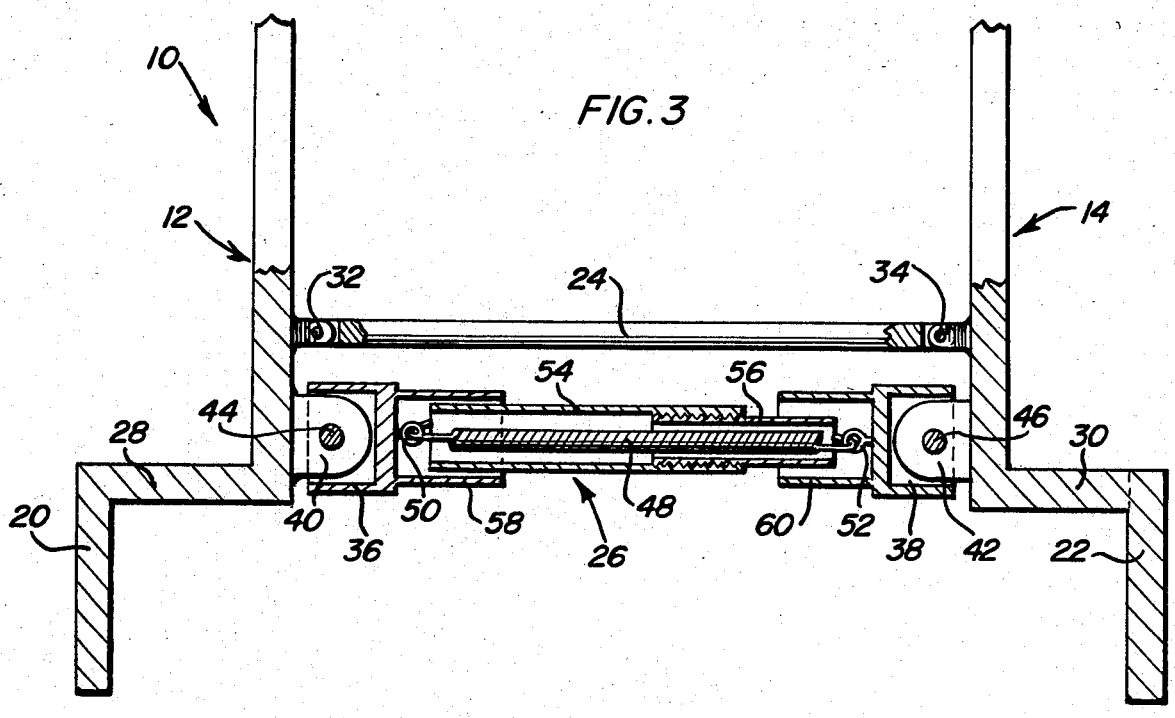
FIG. 3 is a sectional view on line 3—3 of FIG. 2.

The illustrated towel rail clamp 10 comprises a pair of opposed arm members 12, 14 with handle portions 16, 18 at one end, and jaw-forming portions 20, 22 at the other end, the arm members being interconnected by a pivot bar 24 and a spring assembly 26 below the pivot bar for urging the jaw-forming portions toward one another, whereby the handle portions are urged apart. It will be noted that the arm members have outwardly stepped shoulders 28, 30 adjacent the jaw-forming portions, so that the jaw-forming portions are spaced further apart than the handle portions. The jaw-forming portions comprise transversely elongate plate-like elements integrally formed or suitably attached at the lower ends of the respective arm members. The arm members may be formed of any suitable material, such as wood or plastic, for example. Pivot bar 24 is pivotally connected at its opposite ends to the respective arm members by suitable pivot joints 32, 34 allowing the arm members to pivot about the ends of the bar to provide opening and closing movements of the jaws.

Spring assembly 26 comprises a pair of cup-like mounting elements 36, 38 connected to brackets 40, 42 on the respective arm members by pivot pins 44, 46, and a coil spring 48 connected between suitable eyelets 50, 52 on the mounting elements. First and second tubes 54, 56 surrounding the spring, form a stop which limits the spring's action in closing the jaws. The tubes may be threaded together to provide an adjustable jaw stop, or alternatively the tubes may be threaded respectively into tubular extensions 58, 60 on the mounting elements so that the tubes telescope one within the other.

It will be understood that in use, the handle portion 16, 18 may be squeezed together to open jaws 20 and 22 against the spring action, allowing the clamp to be positioned over a towel or superposed towels draped over a towel rail, so as to clamp the towel(s) thereto upon release of the handle portion. The elongated nature of the jaws allows the clamp 10 to be used for clamping adjacent towels.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A clamp for use in securing a towel against sliding off a towel rail over which the towel is draped, or the like, comprising a pair of opposed arm members having jaw-forming portions at one end and handle portions at the other end, a pivot bar interconnecting the arm members intermediate their ends, and a spring assembly interconnecting the arm members adjacent the pivot bar for urging the jaw-forming portions toward one another wherein the spring assembly comprises an elongate coil spring surrounded by tube means forming a stop limiting the extent to which the jaw-forming members are urged toward one another.

2. The invention of claim 1 wherein the tube means comprises telescopic tubes.

3. The invention of claim 1 wherein the tube means comprises tubes threaded together to form an adjustable stop.

4. The invention of claim 1 wherein the coil spring has its ends connected to cup-shaped mounting members pivotally connected to the respective arm members and the tube means has its ends extending into the cup-shaped mounting members.

5. The invention of claim 1 wherein the jaw-forming portions are formed on outwardly extending shoulder portions of the arm members.

6. The invention of claim 5 wherein the spring assembly is connected to the arm members adjacent the shoulder portions, and the pivot bar is located between the spring assembly and the handle portions of the arm members.

7. The invention of claim 1 wherein the jaw-forming portions are transversely elongated in relation to the arm members.

* * * * *